US009205975B2

(12) United States Patent
Giovanni

(10) Patent No.: US 9,205,975 B2
(45) Date of Patent: Dec. 8, 2015

(54) CAPSULE FOR THE PREPARATION OF BEVERAGES

(71) Applicant: Coffee Star S.A., Luxembourg (LU)

(72) Inventor: Accursi Giovanni, Porrestta Terme (IT)

(73) Assignee: CAFFITALY SYSTEM S.P.A., Gaggio Montano (Bologna) (IT)

( * ) Notice: Subject to any disclaimer, the term of this patent is extended or adjusted under 35 U.S.C. 154(b) by 364 days.

(21) Appl. No.: 13/758,365

(22) Filed: Feb. 4, 2013

(65) Prior Publication Data

US 2014/0220189 A1 Aug. 7, 2014

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS 4,865,737 A * 9/1989 McMichael ..... 210/477
2002/0020659 A1* 2/2002 Sweeney et al. ..... 210/416.3
2006/0219098 A1 10/2006 Mandralis et al.
2010/0288131 A1 11/2010 Kilber et al.
2011/0073607 A1 3/2011 Fu et al.
2012/0097602 A1 4/2012 Tedford
2012/0171333 A1 7/2012 Crump et al.
2014/0010926 A1* 1/2014 Digiuni ..... 426/112

FOREIGN PATENT DOCUMENTS

DE 102009007553 8/2010
WO 0160712 A1 8/2001

* cited by examiner

*Primary Examiner* — Rena L Dye
*Assistant Examiner* — Chaim Smith
(74) *Attorney, Agent, or Firm* — Maginot, Moore & Beck, LLP

(57) ABSTRACT

A capsule for making beverages comprising at least one powdered food substance which can be extracted using water to make a beverage, comprises a cup-shaped outer body (2) with a lower wall (3) and a first side wall (4), a lid (6), a filtering body (9) comprising a first basket-shaped rigid or semi-rigid skeleton (10) with a second side wall (11) and a bottom portion (12); the first rigid or semi-rigid skeleton (10) comprises openings (13) made at least through a part of the second side wall (11) which is distanced from the first side wall; the filtering body (9) also comprising at least one layer (26) of flexible filtering material applied to the rigid or semi-rigid skeleton (10) for in use intercepting the beverage which comes out of at least some openings (13) of the filtering body (9) and flows towards the bottom wall (3) and for filtering said beverage.

31 Claims, 7 Drawing Sheets

CAPSULE FOR THE PREPARATION OF BEVERAGES

BACKGROUND

This invention relates to a capsule for making beverages. In particular reference is made to those capsules comprising an outer body and a lid which closes the top of the outer body and in which a powdered food substance (for example coffee powder) is positioned, which can be extracted by passing water (which may be pressurized) through it to make a beverage, for example coffee. More specifically reference is made to those capsules in which the outer body comprises a lower wall and a side wall which form a chamber in which a rigid or semi-rigid filtering body is positioned.

In more detail, reference is made to those capsules suitable for use in beverage making systems in which the capsule is pierced at the lid, to allow the injection of water (which may be pressurized) into the capsule itself, and at the lower wall, to allow dispensing outside the capsule of the beverage produced by the interaction of the water with the powdered food substance.

In such capsules the filtering body is substantially a flat filtering body, normally disk-shaped, positioned close to the lower wall of the capsule outer body and separates the powdered food substance from the lower wall in such a way that powder does not come out of the capsule after a piercing element has penetrated through the lower wall. In fact, the filtering body on one hand allows the beverage to pass through it in such a way that said beverage can come out of the capsule through the lower wall (through a hole made by the piercing element or through a channel present in the latter), and on the other hand allows the powdered food substance to be retained in the capsule.

However, this prior art technology may have several disadvantages under certain circumstances.

In particular, with some types and particle sizes of the powdered food substance, and in the case of dispensing relatively high quantities of beverage (such as American coffee), the prior art capsules may not allow optimum extraction of the powdered food substance. In fact, for example, the beverage made by the interaction between the water and the powder located close to the lid, in order to be able to come out of the capsule must reach the filtering body and therefore must pass through all of the powder below which may obstruct its path. In fact, once moistened with the water, the powdered food substance tends to become compacted, obstructing the flow of the liquids which encounter increased resistance to permeation through the powder.

In fact, the water injected into the capsule tends to cause compacting of the powdered food substance at the filtering body, therefore increasing the resistance of the powdered food substance to the passage of the water through it and resulting in difficulties draining the beverage through it.

Moreover, during the injection of water into the capsule, areas are created in the powder which are compacted to different degrees. Therefore, prior art capsules have the disadvantage that the powdered food substance can only be permeated unevenly, that is to say, to drastically different degrees depending on the position of the powdered food substance in the capsule. Moreover, in prior art capsules, since the water tends to flow in the zones of the powder which are less resistant to permeation, preferential channels for the passage of the water are easily created, the result being that the powdered food substance is not all permeated homogeneously.

A first solution which overcomes those disadvantages is described in Italian patent application No. VR2012A000133 and in the corresponding U.S. patent application Ser. No. 13/549,904 in the name of this Applicant, whose content had still not been disclosed at the time of filing this patent application.

In that case, the disk-shaped filter was replaced with a rigid or semi-rigid filter having the shape of a basket with openings at its side wall, which is distanced from the inner part of the side wall of the outer body. Thanks to that solution it was practically possible to avoid the various clogging problems which may arise with prior art capsules.

However, even that solution did not allow all possible disadvantages to be overcome. In particular, when the powdered substance is not adequately ground and contains an excessive quantity of powder which is below a predetermined particle size, it is possible that powder will leak out with the beverage, with consequent deterioration of the quality of the beverage itself (even if, as is known, the leakage of an extremely small quantity of powder is substantially normal in the preparation of beverages of this type, and in particular of coffee).

Finally, there are also prior art capsules in which in place of a rigid or semi-rigid flat filter there is a conical or frusto-conical filter consisting of a layer of flexible material. However, even these capsules have significant disadvantages. In particular, in the case of dispensing relatively large quantities of beverage, such as American coffee, when the powder gets wet it tends to become compacted on the bottom of the filter, substantially clogging it. At that point the extraction water can no longer penetrate the powder and tends to bypass it, coming out of the filter laterally, above the powder, therefore without any extraction effect. Therefore, the resulting beverage is of poor quality.

SUMMARY

In this context, the technical purpose which forms the basis of this invention is to provide a capsule for making beverages which overcomes the above-mentioned disadvantages.

In particular it is the technical purpose of this invention to provide a capsule for making beverages which allows the water coming in to permeate the powdered food substance in a more even way than prior art capsules, at the same time minimizing the risk of powder coming out with the beverage.

It is also the technical purpose of this invention to provide a capsule for making beverages which allows limitation, compared with prior art capsules, of the risk of forming highly compacted zones, in the powdered food substance, which could obstruct the flow of the beverage, and/or the risk of forming preferential channels for the passage of the water.

The technical purpose specified and the aims indicated are substantially achieved by a capsule for making beverages as described in the appended claims.

DESCRIPTION OF THE FIGURES

Further features and advantages of this invention are more apparent in the detailed description below, with reference to several preferred, non-limiting embodiments of a capsule for making beverages, illustrated in the accompanying drawings, in which.

DETAILED DESCRIPTION

Figure 1:
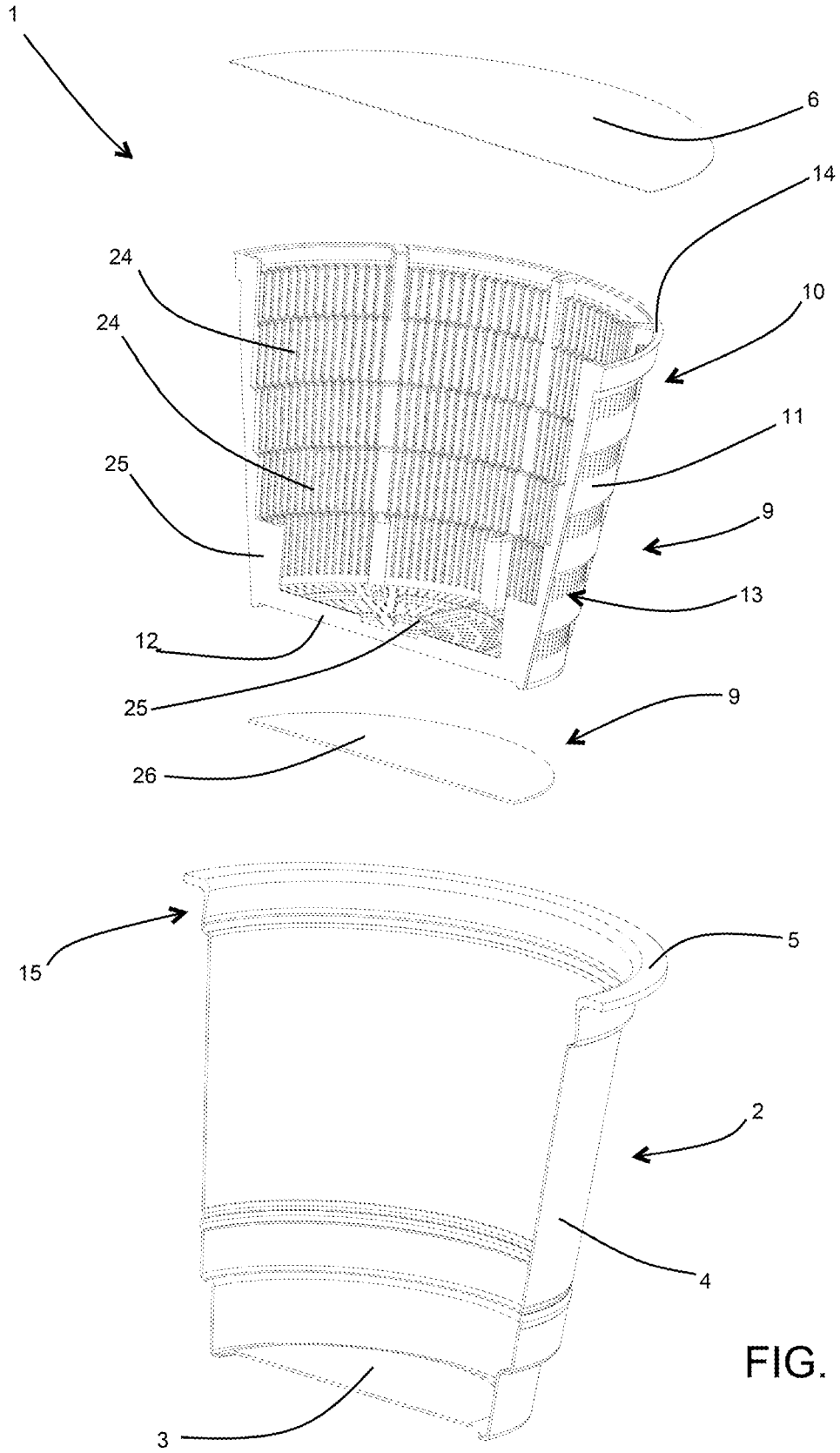
FIG. 1 is a schematic axonometric exploded view of a capsule made according to a first embodiment of this invention, in cross-section along a vertical middle plane.

With reference to the accompanying drawings, the numeral 1 denotes in its entirety a capsule 1 for making beverages in accordance with this invention.

As already indicated, this invention relates to a capsule 1 for making beverages comprising at least one powdered food substance (not illustrated in the accompanying drawings) which can be extracted by passing water through it to make a beverage. The powdered food substance, for example powdered coffee, can be extracted for example by infusion or is soluble to make a beverage such as coffee or tea, infusions, soups, etc. The capsule 1 may be suitable for allowing extraction of the powdered food substance, such as coffee, by passing pressurized water through it, for example to make an espresso coffee. The capsule 1 comprises a substantially cup-shaped outer body 2 which in turn comprises a lower wall 3 and a first side wall 4. In the embodiments illustrated the lower wall 3 of the capsule 1 mainly extends in a disk-shaped fashion and the first side wall 4 extends from it with a shape that to a first approximation is frusto-conical, the upper part of it ending with an upper edge 5 located on the opposite side to the lower wall 3. A lid 6 is fixed to the outer body 2 at the upper edge 5 and closes the top of the outer body 2. The outer body 2 and the lid 6 of the capsule 1 may each be made of different materials. The outer body 2 may, for example, be made of a plastic material whilst the lid 6 may be made of an aluminum sheet (both may be either in a single layer or multi-layered).

Inside the outer body 2, between the lid 6 and the inner surface of the outer body 2, there is a chamber 7. During use of the capsule 1, the beverage is made in the chamber after interaction between the powdered food substance and the water. Between a central point of the lid 6 and a central point of the lower wall 3 is identified an axis of extension 8 of the capsule 1, visible in FIGS. 3, 4 and 5. In all of the embodiments illustrated the capsule 1 is symmetrical relative to the axis of extension 8.

Advantageously, in the embodiments illustrated, the capsule 1 is sealed closed, but in use the lid 6 can be pierced to allow water to be injected into the capsule 1 and the lower wall 3 can also be pierced to allow the beverage to come out of the capsule 1. Therefore, hereinafter reference will preferably be made to this embodiment. However, other embodiments are also possible in which the lid 6 and/or the lower wall 3 are themselves able to allow the passage of water and beverage (for example because they are ready-pierced or permeable).

The capsule 1 is therefore suitable for use in a beverage making system which advantageously comprises a housing in which the capsule 1 can be inserted for use for making a beverage, for example coffee. A system suitable for using the capsule 1 illustrated comprises, in the substantially known way, means for injecting water into the capsule 1, which can be associated with the lid 6, comprising an injecting element such as a needle or a blade which may form a channel for the passage of the water, and it also comprises means for extracting the beverage from the capsule 1, which can be associated with the lower wall 3, said means in turn comprising a piercing element for piercing/penetrating the lower wall 3 of the capsule 1 outer body 2. In this context, the term piercing element refers to any element, substantially of the known type, able to pierce, cut or tear, for example a spike or a blade, fixed or mobile (again in this case if necessary forming a channel for the passage of the water). The piercing element can also pass through the lower wall 3 of the capsule 1 centrally or, preferably, off-center.

The capsule 1 also comprises a filtering body 9 positioned in the chamber 7, and substantially having the shape of a basket, able to allow the passage of the beverage through it and at the same time to substantially retain the powdered food substance so that, during use of the capsule 1, the beverage can pass through the filtering body 9 and then come out of the capsule 1 itself (for example through a hole made by the piercing element in the lower wall 3 or through a channel made in the piercing element itself), whilst the powdered food substance can remain substantially trapped inside.

The filtering body 9 comprises a rigid or semi-rigid skeleton 10 in the shape of a basket which contains the powdered food substance, and which in turn comprises a second side wall 11 and a bottom portion 12. However, the latter may also consist exclusively of a lower edge of the second side wall 11. The rigid or semi-rigid skeleton 10 comprises openings 13 for allowing fluid communication through it. Advantageously the openings 13 are made at least through the second side wall 11. Depending on the embodiments, they may also be made through the bottom portion 12 (as in the cases illustrated in the accompanying drawings) or not.

According to this invention, the second side wall 11 comprises its own upper rim 14 which is substantially annular and the bottom of the second side wall is connected to the bottom portion 12.

In the assembled capsule 1, the upper rim 14 is positioned close to the lid 6 of the capsule 1 (and may or may not be in contact with the lid) and is coupled to the outer body 2 at a coupling portion 15 of the first side wall 4, which is in turn substantially annular and is located close to the upper edge 5 of the first side wall 4. Therefore, advantageously, the upper rim 14 of the filtering body 9 also extends substantially annularly around the axis of extension 8. The coupling between the filtering body 9 and the capsule 1 outer body 2 is described in more detail below.

The bottom portion 12 is in contrast positioned close to the lower wall 3 of the outer body 2, even if it is possible that between the two there is a predetermined distance, for the reasons explained below.

In accordance with this invention the filtering body 9 therefore substantially separates the chamber 7 into a first compartment 16 in which the powered food substance is contained and a second compartment 17. In the preferred embodiment the piercing element, during use, can penetrate the lower wall 3 and be inserted in the second compartment 17 without damaging the filtering body 9. A piercing injecting element may, in contrast, pass through the lid 6 and be inserted directly in the first compartment 16.

Advantageously, as shown in the accompanying drawings, the upper rim 14 of the filtering body 9 substantially delimits an access aperture to the first compartment 16 which in the embodiments illustrated is substantially circular. Therefore, the filtering body 9 is advantageously open at the top, that is to say, on the side facing towards the lid 6. During capsule 1 production, when the lid 6 is separate from the outer body 2, the powdered food substance can therefore be inserted in the first compartment 16 by simply pouring it into said compartment through the access aperture.

Therefore, in the first compartment 16 the powered food substance interacts with the water injected into the capsule 1 to make the beverage. In contrast, the second compartment 17 is intended, during use, to receive the beverage made in the first compartment 16 and which comes out of the latter through the filtering body 9.

Figure 3:
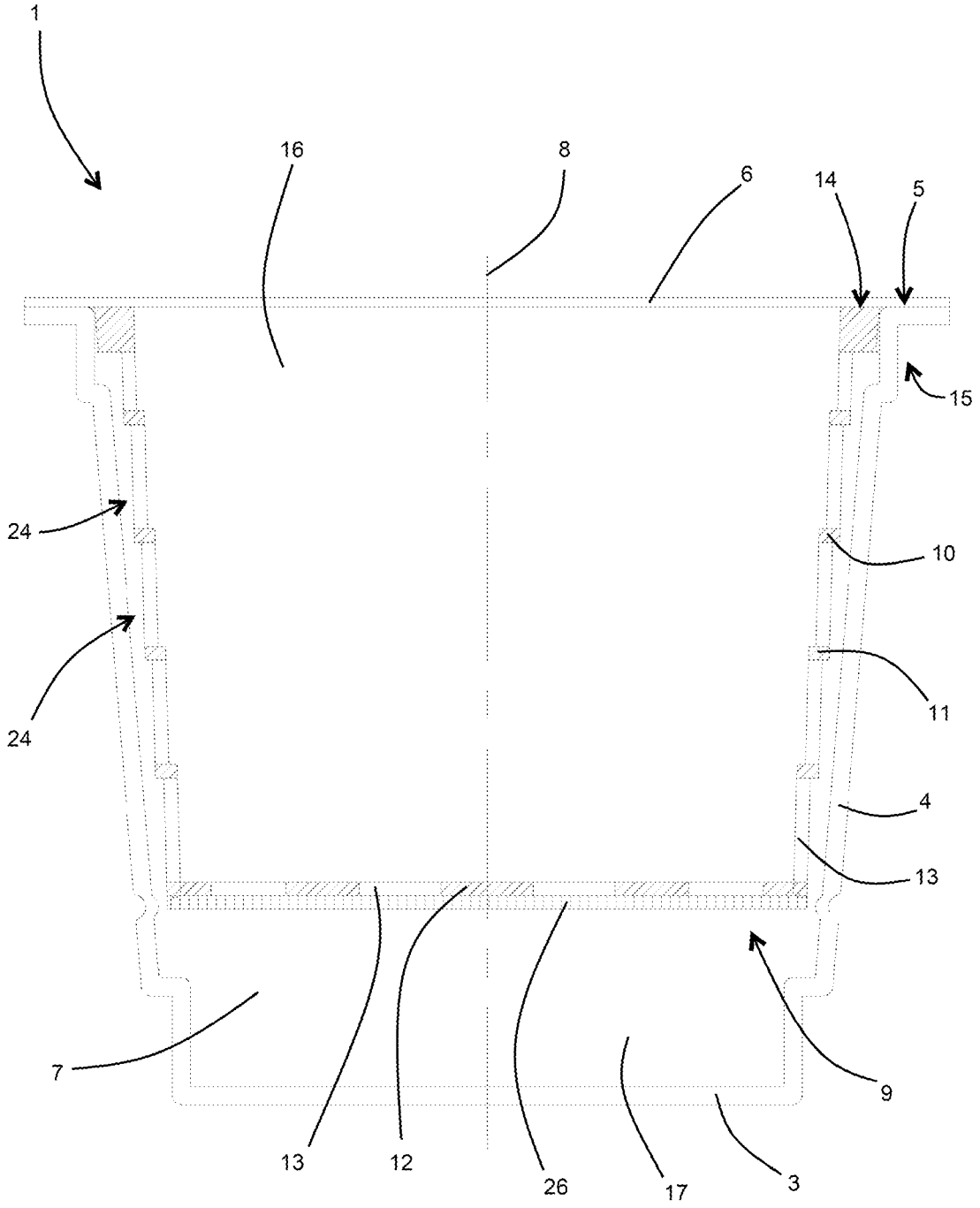
FIG. 3 is a schematic vertical middle cross-section of a capsule made according to a third embodiment of this invention similar to the first embodiment; it should be noticed that for greater clarity FIG. 3 only shows the details visible in the cross-section plane and not those in the background.
Figure 4:
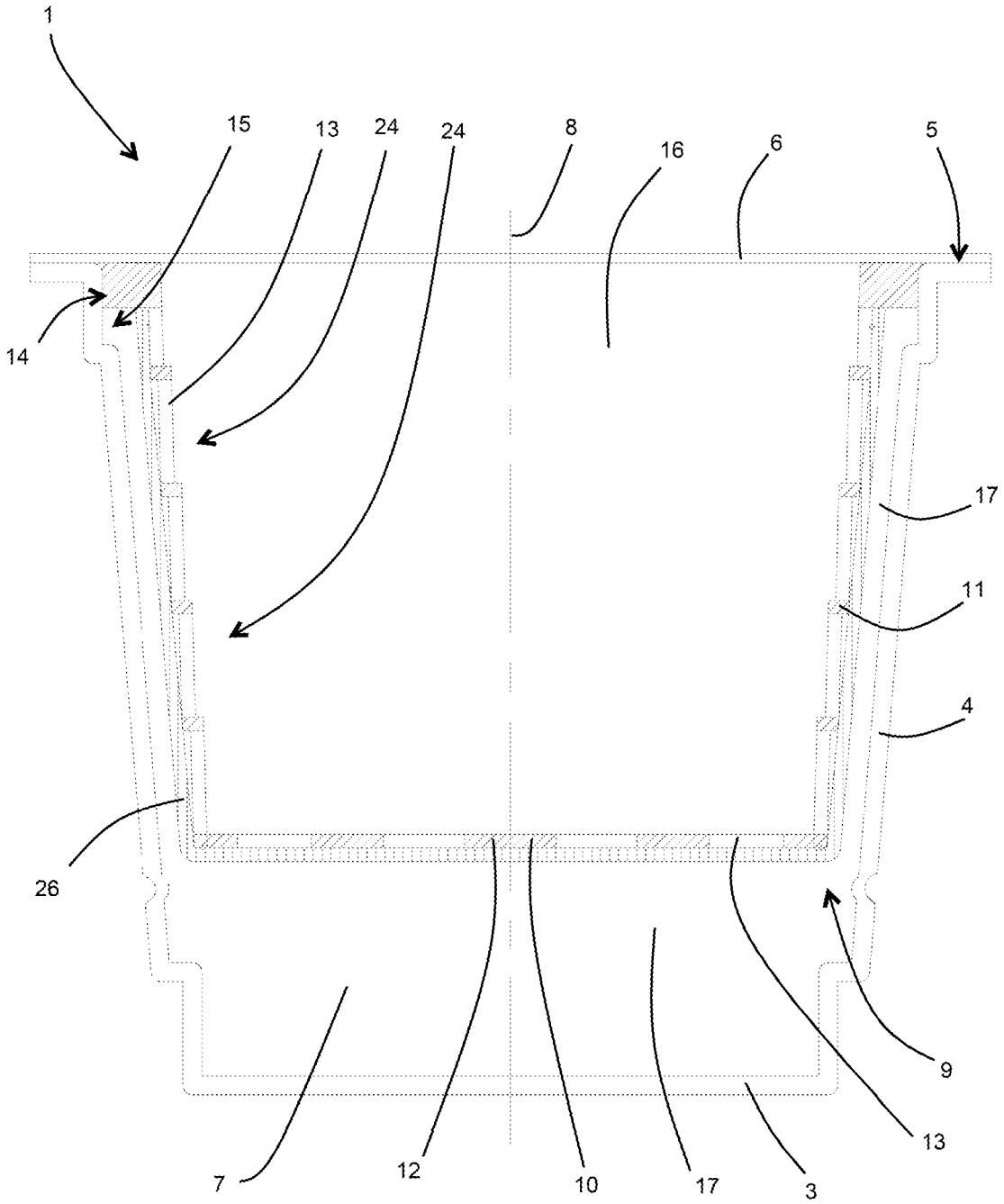
FIG. 4 is a schematic vertical middle cross-section of a capsule made according to a fourth embodiment of this invention similar to the second embodiment; it should be noticed that for greater clarity FIG. 4 only shows the details visible in the cross-section plane and not those in the background.

In accordance with this invention, the first compartment 16 is delimited at least between the filtering body 9 and the lid 6 (FIGS. 3 and 4). However, in many preferred embodiments, the first compartment 16 may also be delimited by a small annular portion of the first side wall 4 located between the upper edge 5 of the first side wall 4 itself and the coupling portion 15 (which, as indicated, is in any case close to the upper edge 5—FIG. 7). The first compartment 16 is therefore at least mainly delimited by the filtering body 9, and advantageously extends over most of the volume of the chamber 7.

According to this invention, the second side wall 11 is at least partly distanced from the first side wall 4 (being placed alongside and facing it) to allow the beverage to flow between them towards the lower wall 3. Advantageously, the openings 13 through the second side wall 11 are made at least at the part of the second side wall 11 which is distanced from the first side wall 4. In this way, said openings 13 allow a reduction, compared with prior art capsules, in the average distance that the water must cover through the powdered food substance in order to be able to come out of the filtering body 9 in the form of the beverage, with the advantage that the water encounters less resistance to its passage through the substance. Consequently, the filtering body 9 allows improved filtering of the beverage, a reduced tendency of the powdered food substance to become unevenly compacted and therefore more even permeation of the powdered food substance by the water injected into the capsule 1.

The second compartment 17 is delimited between the filtering body 9, the lower wall 3 and the portion of the first side wall 4 located between the lower wall 3 and the coupling portion 15, and partly extends between the first side wall 4 and the second side wall 11. In other words, the second compartment 17 surrounds at least part of the filtering body 9. In particular, the second compartment 17 extends along the first side wall 4 at least for most of the distance, measured parallel with the axis of extension 8, between the coupling portion 15 and the lower wall 3, and therefore it surrounds the filtering body 9 along most of its extension parallel with the axis of extension 8.

Even more advantageously, as in the embodiments illustrated in the accompanying drawings, the second compartment 17 extends along the first side wall 4 to the coupling portion 15. Since the filtering body 9 is coupled to the coupling portion 15 at the upper rim 14, the substantial totality of the filtering body 9 is surrounded by the second compartment 17. Advantageously, the openings 13 are distributed over the entire part of the filtering body 9 surrounded by the second compartment 17, and in particular over the entire part of the second side wall 11 which is facing the second compartment 17. Advantageously, in the embodiments illustrated, the openings 13 are evenly distributed around the filtering body 9, being grouped together in groups which are in turn substantially evenly distributed along the extension of the second side wall 11 between the upper rim 14 and the bottom portion 12. However, advantageously, all of the openings 13 made in the second side wall 11 are located at a height which is lower than the maximum height reached by the powdered substance inside the first compartment 16 (where the height is measured relative to the lower wall 3), in such a way as to prevent the water from reaching the openings 13 without having to pass through the powdered substance.

As already indicated, the filtering body 9 is coupled to the first side wall 4 at the coupling portion 15. The coupling may be made in various ways.

In the case in FIGS. 3 and 4 the coupling is only schematically illustrated with the upper rim 14 positioned substantially adjacent to the lid 6.

Figure 7:
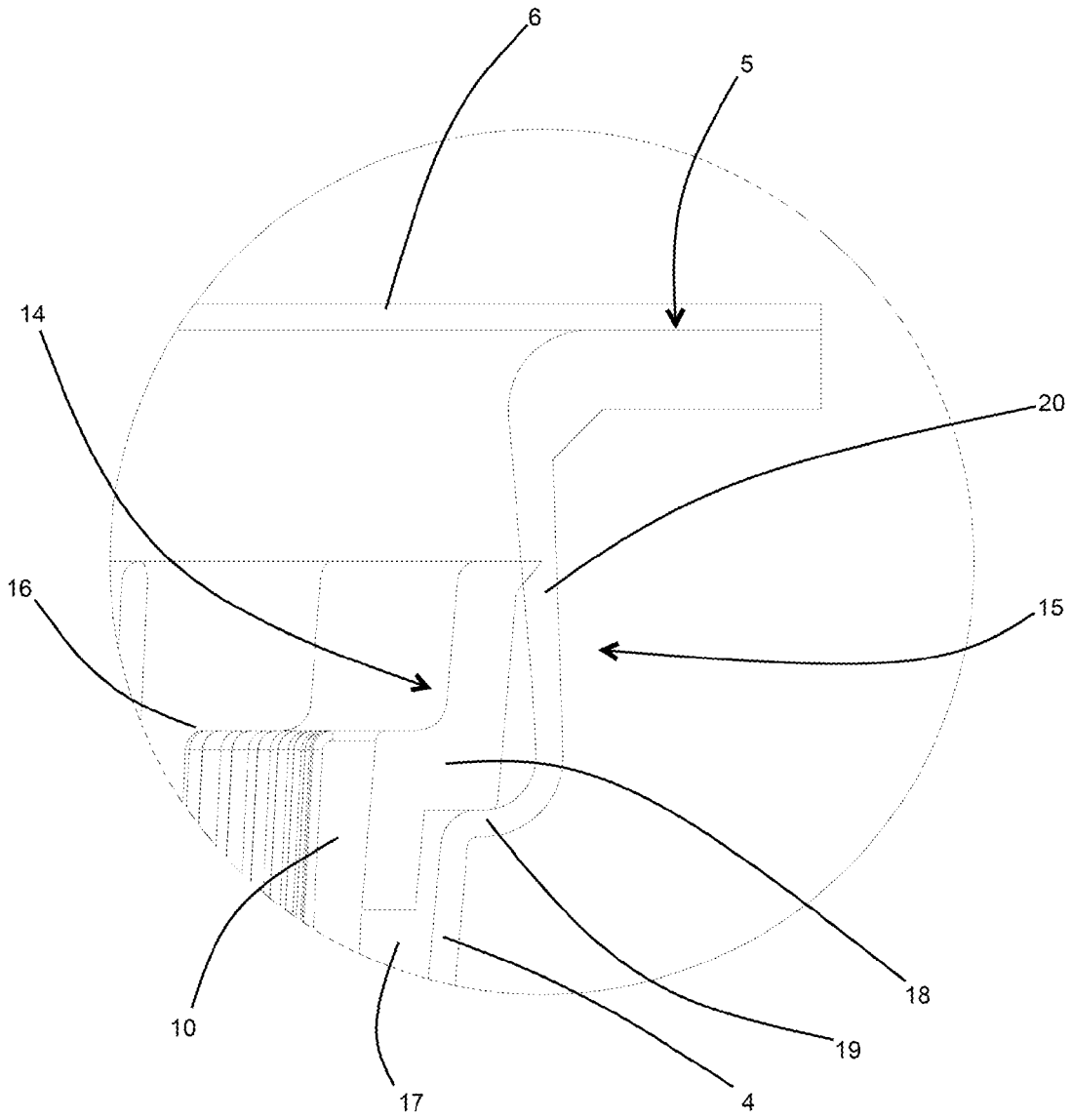
FIG. 7 is a schematic vertical middle cross-section of a detail of the capsule of FIG. 1 in an assembled configuration.

However, a preferred embodiment is illustrated in the detail in FIG. 7, where the rigid or semi-rigid skeleton 10 of the filtering body 9 comprises a shoulder 18, close to the upper rim 14, with substantially annular extension about the axis of extension 8 and projecting radially relative to the rest of the filtering body 9 (again with reference to the axis of extension 8). In other words, seen in a cross-section plane passing through the axis of extension 8, on the outside of the rigid or semi-rigid skeleton 10 there is an inverted step close to the upper rim 14. The filtering body 9 advantageously rests on the coupling portion 15 by means of the shoulder 18. In fact, in the preferred embodiment illustrated, the coupling portion 15 comprises a counter-shoulder 19 which also has substantially annular extension about the axis of extension 8 and which projects radially, with reference to the axis of extension 8, relative to the portion of first side wall 4 adjacent to it and on the lower wall 3 side. Therefore, as shown in FIG. 7, the shoulder 18 rests on the counter-shoulder 19. In the preferred embodiment illustrated, the upper rim 14 is coupled to an annular region 20 of the coupling portion 15 which is located between the counter-shoulder 19 and the upper edge 5 of the first side wall 4 to which the lid 6 is fixed. Therefore, advantageously, in the preferred embodiment, the filtering body 9 is in contact with the outer body 2 of the capsule 1, and in particular with the coupling portion 15, substantially at two annular portions of the rigid or semi-rigid skeleton 10, one corresponding to the upper rim 14 and another corresponding to the shoulder 18. In particular, the contact between the shoulder 18 and the counter-shoulder 19 allows the filtering body 9, once inserted in the capsule 1 outer body 2, to stop at the counter-shoulder 19. In other words, the counter-shoulder 19 acts as a contact element which prevents the filtering body 9 from being subjected to further movements towards the lower wall 3 of the capsule 1. That is particularly useful for keeping the filtering body 9 in a predetermined position, as described in more detail below.

However the coupling is created between the filtering body 9 and the coupling portion 15, the filtering body 9 may advantageously be coupled to the coupling portion 15 by mechanical interference, and, in addition or alternatively, forms a sealed contact with it, where "sealed contact" in this context advantageously refers to a contact which is watertight. Moreover, the sealed contact may also be useful during capsule 1 production. In fact, during insertion of the powdered food substance in the first compartment 16, a sealed contact (at the coupling portion 15) allows a guarantee that the powder cannot accidentally be poured into the second compartment 17 (which would compromise use of the capsule 1 for making the beverage).

The coupling which uses mechanical interference and/or is sealed can be made in various ways.

In the embodiment illustrated in the detail in FIG. 7, the mechanical interference coupling is created between the upper rim 14 of the filtering body 9 and the above-mentioned annular region 20 of the coupling portion 15. To highlight the mechanical interference, in FIG. 7 the upper rim 14 is shown partly overlapping with the annular region 20. In particular, that representation implies that the interference contact between the upper rim 14 and the annular region 20 in reality, advantageously, requires at least one of these to be in a state of deformation (advantageously elastic). Mechanical interference is preferably possible thanks to the elastic deformability of the upper rim 14 and/or of the annular region 20, the elasticity advantageously being allowed by the material used to make them and/or by their shape. In the embodiment illustrated the annular region 20, that is to say, the region of the coupling portion 15 located between the counter-shoulder 19 and the upper edge 5, is advantageously able to bend. In particular, the annular region 20 presses against the upper rim 14 of the filtering body 9 thanks to the elastic deformation to which it is subjected. As shown in FIG. 7, the annular region 20, seen in axial section, also extends at an angle relative to the axis of extension 8: in particular proceeding from the upper edge 5 towards the lower wall 3 the annular region 20 moves away from the axis of extension 8. Moreover, the coupling portion 15 at the upper edge 5 or at the part of the annular region 20 adjacent to the upper edge 5, delimits a cross-section, perpendicularly to the axis of extension 8, which is advantageously less than the area delimited by the upper rim 14 in the plane perpendicular to the axis of extension 8. Advantageously, for that reason, during capsule 1 production the coupling portion 15, and in particular in the preferred embodiment its annular region 20, resists the passage of the upper rim 14 during the end step of filtering body 9 insertion in the chamber 7. Filtering body 9 insertion in the chamber 7 therefore requires pressure to be applied on the filtering body 9, directed towards the lower wall 3, at least as the upper rim 14 passes at the annular region 20. In the preferred embodiment illustrated, advantageously, the pressure on the filtering body 9 is applied until the shoulder 18 is resting against the counter-shoulder 19, thus creating a snap-on type insertion. That particular shape of the coupling portion 15 and its interaction with the filtering body 9, and in particular with the upper rim 14, advantageously prevents removal of the filtering body 9 from inside the capsule 1 outer body 2, for example after a thrust applied on the bottom portion 12 of the filtering body 9 and directed towards the lid 6.

Moreover, advantageously, the sealed contact is also created between the upper rim 14 of the filtering body 9 and the annular region 20 of the coupling portion 15. In particular, in the embodiments illustrated, the upper rim 14 and the annular region 20 are made in such a way that between them there is continuous contact, and the seal is guaranteed by mechanical interference.

As already indicated, to avoid contact with the piercing element as it penetrates into the second compartment 17 (if the lower wall 3 can be pierced), the filtering body 9 will advantageously have a shape that allows the piercing element to enter but at the same time avoids contact with it, considering its dimensions, the related stroke and its positioning.

Advantageously, in some preferred embodiments (FIGS. 1 to 4), this is achieved thanks to the fact that the bottom portion 12 of the filtering body 9 is spaced from the lower wall 3 to allow, during capsule 1 use in a system suitable for using it, insertion of the piercing element in the capsule 1, through the lower wall 3, without the bottom portion 12 of the filtering body 9 being damaged. Moreover, the bottom portion 12 of the filtering body 9 preferably mainly comprises a substantially flat disk.

In the embodiment illustrated in FIGS. 1 and 7, the position of the counter-shoulder 19 on the coupling portion 15 and the position of the shoulder 18 on the filtering body 9, are established to determine a distance between the lower wall 3 of the outer body 2 and the bottom portion 12 of the filtering body 9 which is greater than the distance between the tip of the piercing element and the lower wall 3 when the piercing element is inserted in the capsule 1.

Figure 5:
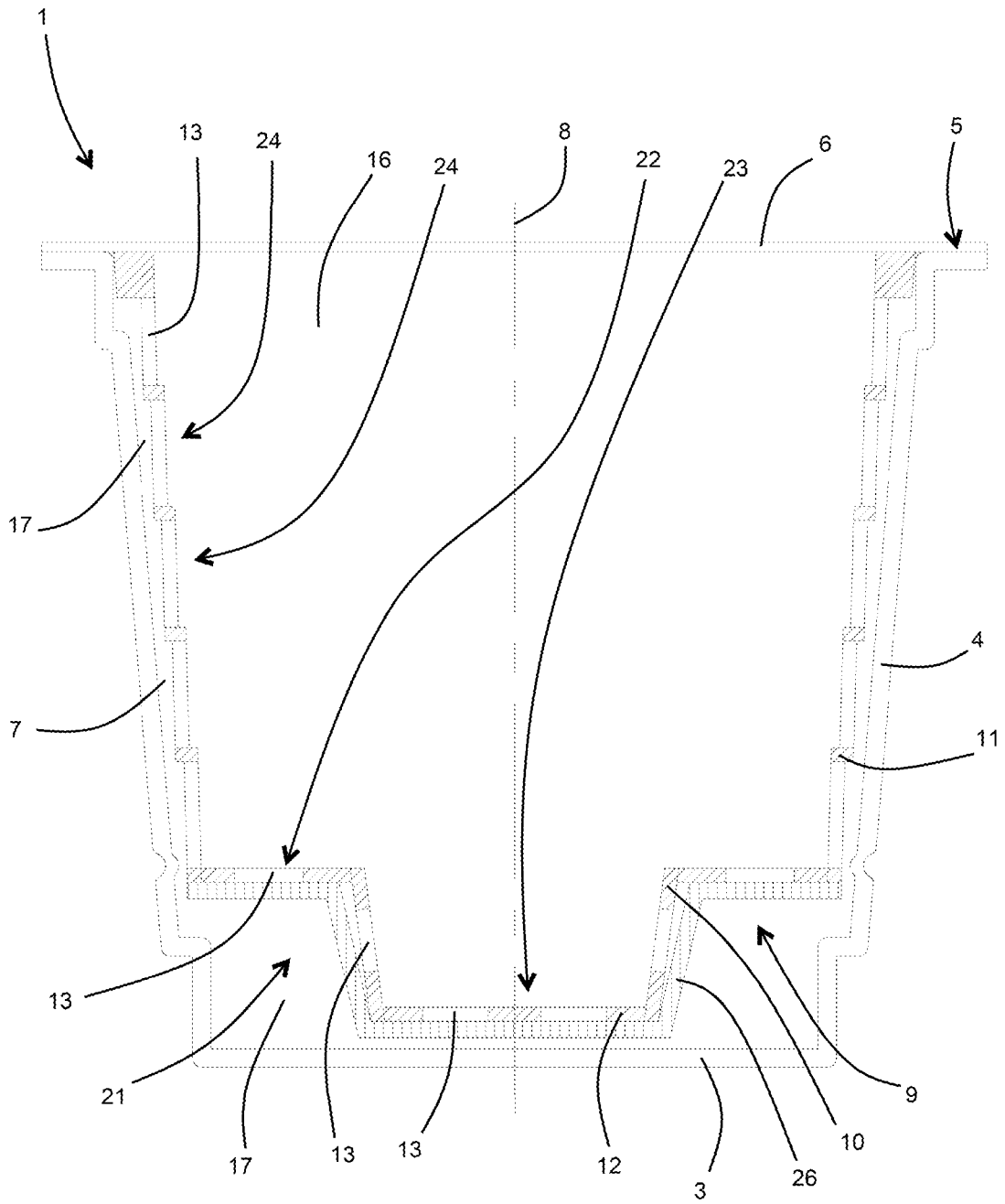
FIG. 5 is a schematic vertical middle cross-section of a capsule made according to a fifth embodiment of this invention; it should be noticed that FIG. 5 also only shows the details visible in the cross-section plane and not those in the background.

Alternatively, the bottom portion 12 may comprise a recess 21 towards the lid 6 in which the piercing element can be inserted. The dimensions of the recess 21 will be proportionate to those of the piercing element and to the related stroke that it must cover inside the capsule 1 (the distance between the lower wall 3 and the tip of the piercing element, when the latter is inserted in the capsule 1). Depending if the piercing element passes through the lower wall 3 centrally or off-center, the recess 21 will be located respectively at the center of the bottom portion 12 or off-center relative to the axis of extension 8, in the latter case having an extension that is advantageously annular about it. This configuration is illustrated in FIG. 5 where the bottom portion 12 comprises an outer annular zone 22 and an inner zone 23. The outer annular zone 22 is spaced from the lower wall 3, whilst the inner zone 23 is in contrast close to the lower wall 3.

Alternatively to the presence of an annular recess 21 (therefore, when the piercing element is off-center relative to the axis of extension 8), the filtering body 9 may have a substantially conical shape, the taper being such that it prevents contact with the piercing element even when it is completely inserted (considering its maximum stroke) in the second compartment 17.

Figure 2:
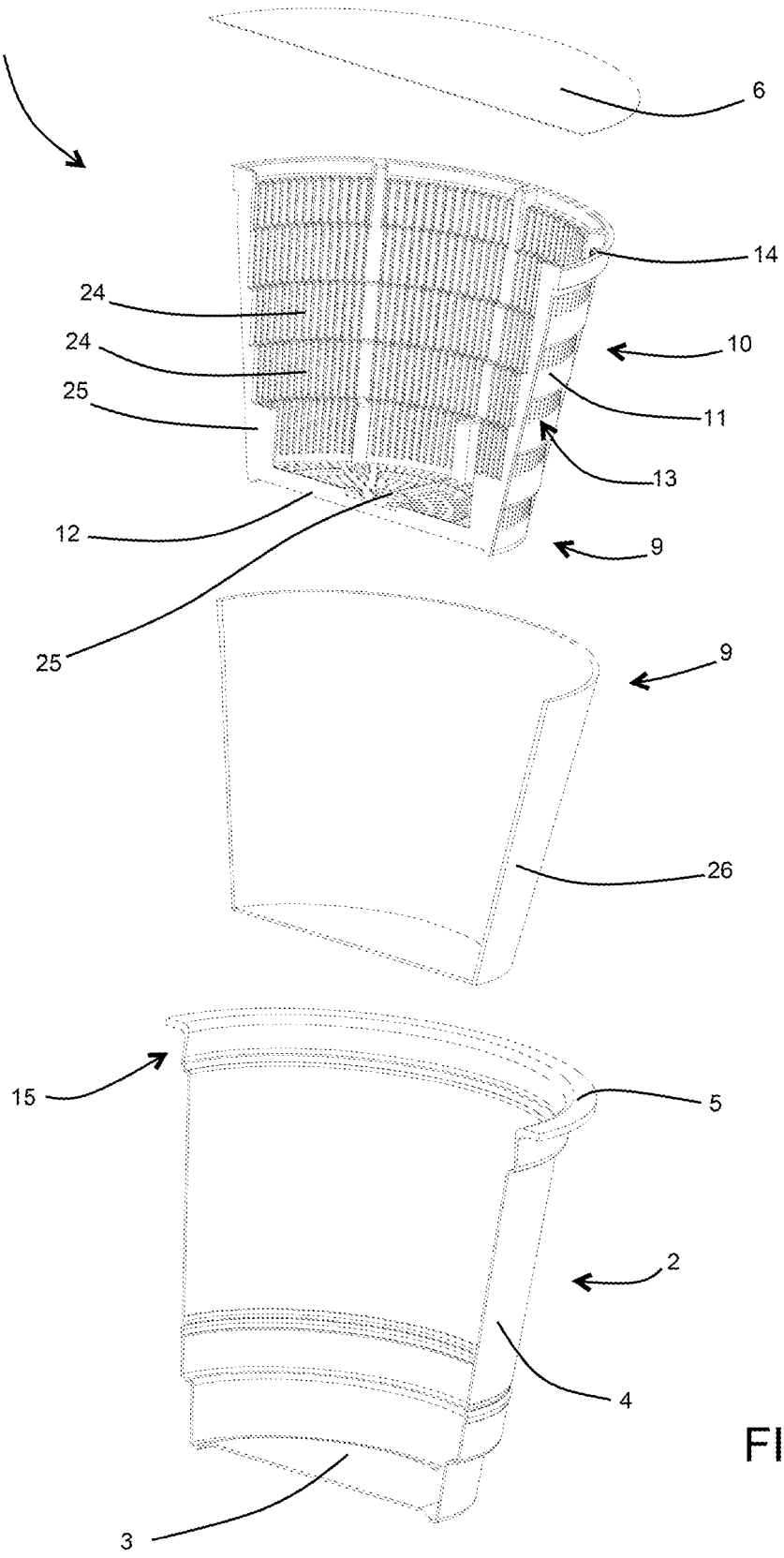
FIG. 2 is a schematic axonometric exploded view of a capsule made according to a second embodiment of this invention, in cross-section along a vertical middle plane.

Again with reference to the shape of the filtering body 9, the top of it is, as already indicated, in contact with the first side wall 4 at the coupling portion 15. In contrast, the bottom of the filtering body 9 is spaced from the first side wall 4, that is to say between the first side wall 4 of the outer body 2 and the second side wall 11 of the filtering body 9 there is an empty space which corresponds to the part of the second compartment 17 positioned between the first side wall 4 and the filtering body 9. Advantageously, the distance between the filtering body 9 and the first side wall 4 at the second compartment 17 increases proceeding towards the bottom portion 12. For example, if the first side wall 4 extends in a substantially conical fashion with reference to the axis of extension 8, proceeding from the lid 6 towards the lower wall 3, the second side wall 11 of the filtering body 9 may have a similar extension but with a more pronounced taper (FIGS. 1 and 2). Moreover, in the preferred embodiments illustrated, the second side wall 11 of the filtering body 9 has the structure of superposed rings 24, which are concentric about the axis of extension 8 and connected to each other. Each ring 24, proceeding from the upper rim 14 towards the bottom portion 12 of the filtering body 9, delimits a respective section of the first compartment 16, in a plane substantially perpendicular to the axis of extension 8, having an area greater than that delimited by the next ring 24. Advantageously, in the embodiments illustrated in FIGS. 1 and 2, the same ring 24 delimits various sections of the first compartment 16 (which are perpendicular to the axis of extension 8) which have decreasing areas proceeding in the direction from the upper rim 14 towards the bottom portion 12. In other words, each ring 24, proceeding from the upper rim 14 towards the bottom portion 12, converges towards the axis of extension 8. In the preferred embodiment illustrated, each section delimited by a ring 24 is substantially circular and its center is identified by the intersection with the axis of extension 8.

Said structure of the second side wall 11 of the rigid or semi-rigid skeleton 10 gives it rigidity and makes its production easier, which advantageously can be carried out using injection molding.

The second side wall 11, seen in radial section relative to the axis of extension 8, therefore comprises, on the side facing towards the first compartment 16, a substantially stepped profile, each step corresponding to one of the rings 24. Advantageously, even the on the side facing towards the first side wall 4 the second side wall 11 of the filtering body 9 comprises a stepped profile, each step radially recessed, with reference to the axis of extension 8, relative to the adjacent step positioned between it and the upper rim 14. In other words, the second side wall 11 of the filtering body 9 comprises inner steps, formed by the rings 24, and outer steps, facing towards the first side wall 4. As shown in FIGS. 1 and 2, the inner steps and the outer steps may not be aligned with each other. In particular, in the first and second embodiments each outer step extends substantially from approximately half the height, measured parallel with the axis of extension 8, of each inner step. However, in other embodiments, other configurations and structures are possible for the second side wall 11, such as those schematically illustrated in FIGS. 3, 4 and 5.

In the first and second embodiments the filtering body 9 also comprises ribs 25 for stiffening it which, advantageously, are located at least on the second side wall 11 of the rigid or semi-rigid skeleton 10. As shown in FIGS. 1 and 2 of the accompanying drawings, advantageously, the ribs 25 of the second side wall 11 extend longitudinally from the upper rim 14 at least to the bottom portion 12 and lie substantially in planes passing through the axis of extension 8. Preferably, the ribs 25 also extend on the bottom portion 12. In the preferred embodiments illustrated, more precisely, some ribs 25 extend over radial stretches (with reference to the axis of extension 8) on the bottom portion 12 whilst other ribs 25 extend over annular stretches about the axis of extension 8. The ribs 25 with annular extension and radial extension may meet one another, as is clearly shown in FIGS. 1 and 2. Some ribs 25 of the bottom portion 12 which extend radially may also extend from the ribs 25 of the second side wall 11.

In the embodiments illustrated, the ribs 25 of the second side wall 11 extend on the rings 24 and on the outer steps in which the second side wall 11 is structured and they project radially relative to the latter, creating an overall frusto-conical shape: in other words, each rib 25 is angled in such a way that, proceeding from the upper rim 14 towards the bottom portion 12 of the filtering body 9, the distance between its outer surface and the capsule 1 axis of extension 8 is reduced.

In the preferred embodiment the ribs 25 do not make contact with the capsule 1 outer body 2, except at the coupling portion 15. However, in general the filtering body 9 may be in contact with the capsule 1 outer body 2 even at various points other than the coupling portion 15, such as the outer surfaces of the ribs 25, provided that there is no interruption in the fluid communication both through the filtering body 9 and with the beverage outfeed zone through the lower wall 3. Therefore, in some embodiments, one or more of the ribs 25 present on the second side wall 11 and/or on the bottom portion 12 may be in contact with the capsule 1 outer body 2: for example the longitudinal ribs 25 present on the second side wall 11 could be in contact at one or more points with the first side wall 4, whilst between one rib 25 and another the filtering body 9 is distanced from the first side wall 4. As already indicated, the rigid or semi-rigid skeleton 10 comprises openings 13 which allow fluid communication, that is to say, which allow the passage of the beverage from the first compartment 16 towards the second compartment 17.

As indicated, the openings 13 are located at least on the second side wall 11. In the preferred embodiments illustrated, there are several openings 13 on each of the rings 24 of the rigid or semi-rigid skeleton 10. In the embodiments illustrated, in particular, the openings 13 made in the second side wall 11 are formed by slits extending mainly parallel with the axis of extension 8, being arranged side by side. As shown in FIGS. 3 to 5, the slits extend substantially over the entire height of each ring 24 (and therefore of each inner step). In contrast, in the first and second embodiments each through slit only extends on a portion of each ring 24.

As already indicated, the openings 13 are advantageously also made in the bottom portion 12 (which mainly has the shape of a flat disk). In the embodiments illustrated, said openings 13 are elongate slots extending on the bottom portion 12 in directions which are radial relative to the axis of extension 8.

However, more generally, whatever the shape of the filtering body 9 and wherever the openings 13 are positioned, they may have a different shape, orientation, arrangement and dimensions, for example, they may be circular holes, or cross-shaped, elongate slits, curves, etc. Moreover, the same rigid or semi-rigid skeleton 10 may comprise different types of openings 13.

Finally, according to this invention the filtering body 9 also comprises at least one layer 26 of flexible filtering material applied to the rigid or semi-rigid skeleton 10 for in use intercepting the beverage which comes out of at least several openings 13 in the filtering body 9 and flows towards the lower wall 3 and for filtering said beverage.

In particular, depending on the embodiments, the layer 26 may be applied directly at least at several openings 13 in the rigid skeleton 10, or it may be operatively associated with them in a different way, as described in more detail below with reference to the embodiment shown in FIG. 6. Said flexible filtering material may be, for example, non-woven fabric, fabric, paper, etc.

Depending on the embodiments, the openings 13 where the layer of flexible filtering material 26 is applied or to which it is operatively associated may have a shape and/or size which allows the passage of the powdered food substance through them. In the preferred embodiments that is not the case, and all of the openings 13 are of a size which filters the powdered food substance, retaining it at least above a predetermined particle size (usually less than the nominal particle size of the powdered substance).

In contrast, it is always the case that the openings 13 where the layer of flexible filtering material 26 is not applied or to which it is not operatively associated have a size which acts as a filter for the powdered food substance, for retaining it at least above a predetermined particle size.

If the layer 26 is applied at the openings 13, and the rigid or semi-rigid skeleton 10 also comprises openings 13 through the bottom portion 12, depending on requirements it may be the case that either the layer 26 of flexible filtering material is applied exclusively at all of the openings 13 made through the bottom portion 12 and the openings 13 made in the second side wall 11 are of a size such that they act as a filter for the powdered food substance (FIGS. 1, 3 and 5), or that the layer 26 of flexible filtering material is applied exclusively at all of the openings 13 made through the second side wall 11 of the rigid or semi-rigid skeleton 10 and that the openings 13 made in the bottom portion 12 in contrast are of a size such that they act as a filter for the powdered food substance. Although the choice between the two solutions depends on production requirements dictated on each occasion by the features of the powdered food substance used, in general the former is preferable.

According to a further embodiment illustrated in FIGS. 2 and 4, in contrast, the layer 26 of flexible filtering material is applied at all of the openings 13 made through the rigid or semi-rigid skeleton 10. In particular, in the embodiments illustrated that is achieved by also shaping the flexible filtering material in a single piece with the shape of a basket.

If the bottom portion 12 comprises a recess 21 (as in the case in FIG. 5), the layer 26 of flexible filtering material may be shaped to follow the shape of the bottom portion 12.

In other embodiments, not illustrated, the flexible filtering material may instead be used in a plurality of smaller pieces, each fixed to the rigid or semi-rigid skeleton 10 at one or more openings 13.

Figure 6:
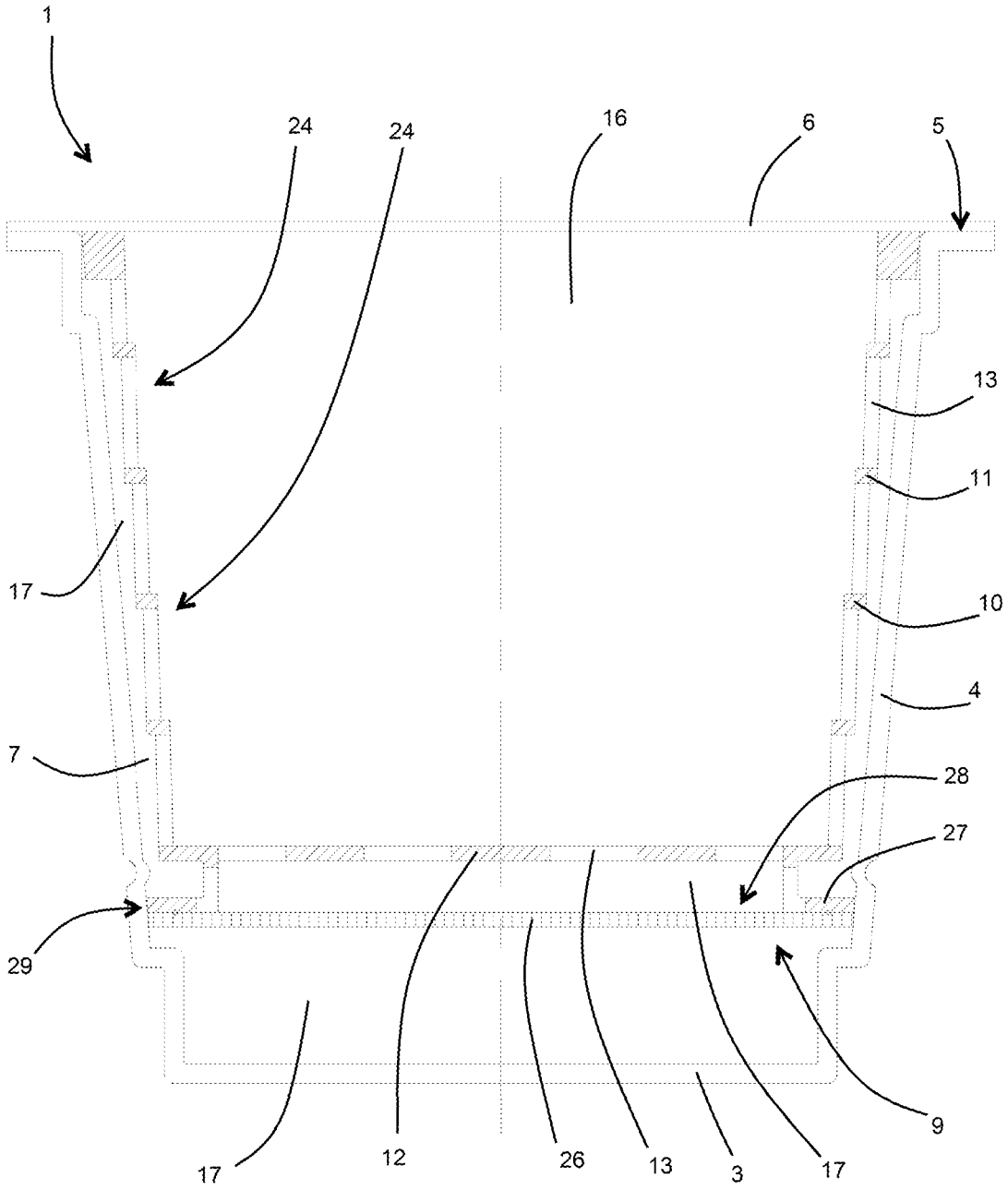
FIG. 6 is a schematic vertical middle cross-section of a capsule made according to a sixth embodiment of this invention; it should be noticed that FIG. 6 also only shows the details visible in the cross-section plane and not those in the background.

In contrast, in the embodiment in FIG. 6 the layer 26 is not applied directly at the openings 13, but is distanced from them for intercepting the beverage only after it has passed into the second compartment 17. In particular, in this embodiment the bottom of the rigid or semi-rigid skeleton 10 comprises a projection 27 which is coupled in a sealed fashion to the first side wall 4. In turn, the projection 27 defines one or more passages 28 in fluid communication with the above-mentioned at least several openings 13, and the layer 26 of flexible filtering material is coupled to the one or more passages 28 for intercepting all of the beverage which comes out of said at least several openings 13 and which flows towards the lower wall 3.

In particular, in the embodiment in FIG. 6, the projection 27 and the layer 26 together form a filtering panel which is interposed between the bottom portion 12 and the lower wall 3 for intercepting the beverage coming out of all of the openings 13, and comprises a perimetric edge 29 which is in turn coupled in a sealed fashion to the first side wall 4 and forms a single passage 28 closed by the layer 26.

However, advantageously, in the preferred embodiments of this invention, on one hand all of the openings 13 are of a size such that they act as a filter for the powdered food substance, for retaining it at least above a predetermined particle size, and on the other hand, the layer 26 of flexible filtering material is applied either only at the openings 13 made in the bottom portion 12 or at all of the openings 13.

The flexible filtering material can advantageously be fixed to the rigid or semi-rigid skeleton 10 in any way suitable for the purpose, for example by sealing, gluing, or molding the rigid or semi-rigid skeleton 10 directly on the layer 26 of material.

However, in general, advantageously each piece of the flexible filtering material is fixed to the rigid or semi-rigid skeleton 10 along a continuous line which completely surrounds the openings 13 or the passages 28 involved in such a way as to prevent the formation of passages 28 which may allow the beverage to pass from the openings 13 to the lower wall 3 without passing through the at least one layer 26 of flexible filtering material.

As indicated, the capsule 1 is suitable for use in a beverage making system based on capsules which comprises water injecting means that can be associated with the capsule 1 lid 6 and beverage extracting means which can be associated with the lower wall 3 of the capsule 1. In particular, in the preferred embodiment, an injecting element which pierces the lid 6 is used to inject the water into the first compartment 16 which contains the powdered food substance.

The water interacts with the powdered food substance, making the beverage which, driven by the flow of the water (which may be pressurized), passes through the powder, covering stretches of it until it reaches the openings 13 present in the filtering body 9, and if necessary passing through the subsequent layer 26 of flexible filtering material. While the powdered food substance at least mainly remains confined in the first compartment 16, the beverage passes through the openings 13 from the first compartment 16 to the second compartment 17, where it can come out of the capsule 1 after the action of the piercing element which penetrates the lower wall 3. Depending on the type of beverage making system, the beverage may come out through the hole left by the piercing element or through a channel present in said element.

Any grains of powder which manage to pass beyond the openings 13 with which the layer 26 of flexible filtering material is associated, are then retained by the latter material. Unlike what happens in prior art capsules with flexible filtering material filters, in the preferred embodiment in which the openings 13 are of a size such that they act as a filter for the powdered food substance, for retaining it at least above a predetermined particle size, it is possible to prevent any clogging of the layer 26 itself, since most of the powdered substance is retained directly by the rigid or semi-rigid skeleton 10.

This invention brings important advantages.

The basket shape of the filtering element and the presence of the openings on the second side wall allow a reduction in the average distance that the water must cover through the powdered food substance in order to be able to come out of the filtering body. For example, the beverage made close to the lid is not forced to pass through substantially all of the powdered food substance in order to be able to come out through the bottom portion of the filtering body, but can come out through the above-mentioned openings closer to it. In that way, the beverage encounters less resistance during its movement. Moreover, in that way, the risk of the formation of highly compacted areas linked to the substantially unidirectional flow of water and beverage is reduced. In this way, while the beverage is being made the powdered food substance maintains substantially even compactness, consequently reducing the risk of the formation of preferential water flow channels, and the water can therefore permeate the food substance more evenly and homogeneously, leading to an increase in the quality of the beverage made.

Combining at least several of the openings with the layer of flexible filtering material allows a reduction, or even elimination, of the micro-granules of powder which come out with the beverage.

Added to that is the fact that the filtering body of the capsule which is the subject of this invention, thanks to its shape and the presence of the above-mentioned openings, comprises a filtering surface greater than that of a common flat filtering body (the dimensions of the capsule being the same), while keeping the quantity of powdered food substance contained in it substantially unchanged. That allows improved filtering of the beverage.

Finally, it should be noticed that this invention is relatively easy to produce and that even the cost linked to implementing the invention is not very high.

The invention described above may be modified and adapted in several ways without thereby departing from the scope of the inventive concept. Moreover, all details of the invention may be substituted with other technically equivalent elements and the materials used, as well as the shapes and dimensions of the various components, may vary according to requirements.

The invention claimed is:

1. A capsule for making beverages comprising at least one powdered food substance which can be extracted by passing water through it to make a beverage, comprising:

a substantially cup-shaped outer body which in turn comprises a lower wall and a first side wall;

a lid fixed to the outer body at an upper edge of the first side wall located on the opposite side to the lower wall, between the lid and the inner surface of the outer body there also being a chamber and between a central point of the lid and a central point of the lower wall being identified a capsule axis of extension;

a filtering body comprising a basket-shaped rigid or semi-rigid skeleton containing the powdered food substance, positioned in the chamber and comprising a second side wall and a bottom portion, the second side wall comprising a substantially annular upper rim and the bottom of the second side wall being connected to the bottom portion;

the rigid or semi-rigid skeleton comprising openings for allowing fluid communication through it which are made at least through the second side wall;

the upper rim being positioned close to the lid of the capsule and coupled to the outer body at a coupling portion of the first side wall, which is substantially annular and is located close to the upper edge of the first side wall itself;

the bottom portion being positioned close to the lower wall of the outer body;

the second side wall being at least partly distanced from the first side wall for allowing the beverage to flow towards the lower wall, the openings through the second side wall being made at least at the part of the second side wall which is distanced from the first side wall; and the filtering body also comprising at least one layer of flexible filtering material applied to the rigid or semi-rigid skeleton for in use intercepting the beverage which comes out of at least some openings of the filtering body and flows towards the lower wall and for filtering said beverage.

2. The capsule according to claim 1, wherein the layer of flexible filtering material is applied at least at several openings.

3. The capsule according to claim 2, wherein the rigid or semi-rigid skeleton also comprises said openings through the bottom portion, and wherein the layer of flexible filtering material is applied exclusively at all of the openings made through the bottom portion of the rigid or semi-rigid skeleton, the openings made in the second side wall being of a size such that they act as a filter for the powdered food substance.

4. The capsule according to claim 3, wherein all of the openings made in the rigid or semi-rigid skeleton are of a size such that they act as a filter for the powdered food substance.

5. The capsule according to claim 3, wherein the filtering body is coupled to the coupling portion by mechanical interference and/or the filtering body is in sealed contact with it.

6. The capsule according to claim 2, wherein the rigid or semi-rigid skeleton also comprises said openings through the bottom portion, and wherein the layer of flexible filtering material is applied exclusively at all of the openings made through the second side wall of the rigid or semi-rigid skeleton, the openings made in the bottom portion being of a size such that they act as a filter for the powdered food substance.

7. The capsule according to claim 6, wherein all of the openings made in the rigid or semi-rigid skeleton are of a size such that they act as a filter for the powdered food substance.

8. The capsule according to claim 6, wherein the filtering body is coupled to the coupling portion by mechanical interference and/or the filtering body is in sealed contact with it.

9. The capsule according to claim 2, wherein the layer of flexible filtering material is applied at all of the openings made through the rigid or semi-rigid skeleton.

10. The capsule according to claim 9, wherein all of the openings made in the rigid or semi-rigid skeleton are of a size such that they act as a filter for the powdered food substance.

11. The capsule according to claim 9, wherein the filtering body is coupled to the coupling portion by mechanical interference and/or the filtering body is in sealed contact with it.

12. The capsule according to claim 2, wherein all of the openings made in the rigid or semi-rigid skeleton are of a size such that they act as a filter for the powdered food substance.

13. The capsule according to claim 2, wherein the second side wall is distanced from the first side wall at least for most of its extension and/or wherein the distance between the second side wall and the first side wall increases proceeding from the upper rim towards the bottom portion.

14. The capsule according to claim 2, wherein the filtering body is coupled to the coupling portion by mechanical interference and/or the filtering body is in sealed contact with it.

15. The capsule according to claim 2, wherein, close to the upper rim, the filtering body comprises a shoulder which is substantially annular about the axis of extension and which projects radially relative to the rest of the filtering body with reference to the axis of extension, and wherein the coupling portion comprises a counter-shoulder which is substantially annular about the axis of extension and also projects radially, with reference to the axis of extension, relative to the portion of the first side wall adjacent to it on the lower wall side, said shoulder resting on the counter-shoulder and said upper rim being coupled to an annular region of the coupling portion located between the counter-shoulder and the upper edge.

16. The capsule according to claim 2, wherein the bottom portion of the filtering body is at least partly spaced from the lower wall to allow, during use, insertion of a piercing element in the capsule, through the lower wall, without the bottom portion of the filtering body being damaged.

17. The capsule according to claim 16, wherein the bottom portion comprises an outer annular zone and an inner zone, the outer annular zone being spaced from the lower wall to allow, during use, insertion of a piercing element in the capsule, through the lower wall, without the bottom portion of the filtering body being damaged, the inner zone in contrast being close to the lower wall.

18. The capsule according to claim 2, wherein the lower wall can be pierced during use to allow the beverage to come out of the capsule, and wherein, during use, a piercing element can be inserted between the filtering body and the outer body, without damaging the filtering body, following penetration through the lower wall.

19. The capsule according to claim 1, wherein the rigid or semi-rigid skeleton inferiorly comprises a projection coupled in a sealed fashion to the first side wall and defining one or more passages in fluid communication with said at least some openings, the layer of flexible filtering material being coupled to the one or more passages for intercepting all of the beverage which comes out of said at least some openings and which flows towards the lower wall.

20. The capsule according to claim 19, wherein the projection and the layer of flexible filtering material form a filtering septum which is interposed between the bottom portion and the lower wall for intercepting the beverage coming out of all of the openings.

21. The capsule according to claim 20, wherein all of the openings made in the rigid or semi-rigid skeleton are of a size such that they act as a filter for the powdered food substance.

22. The capsule according to claim 20, wherein the filtering body is coupled to the coupling portion by mechanical interference and/or the filtering body is in sealed contact with it.

23. The capsule according to claim 19, wherein all of the openings made in the rigid or semi-rigid skeleton are of a size such that they act as a filter for the powdered food substance.

24. The capsule according to claim 19, wherein the filtering body is coupled to the coupling portion by mechanical interference and/or the filtering body is in sealed contact with it.

25. The capsule according to claim 1, wherein all of the openings made in the rigid or semi-rigid skeleton are of a size such that they act as a filter for the powdered food substance.

26. The capsule according to claim 1, wherein the second side wall is distanced from the first side wall at least for most of its extension and/or wherein the distance between the second side wall and the first side wall increases proceeding from the upper rim towards the bottom portion.

27. The capsule according to claim 1, wherein the filtering body is coupled to the coupling portion by mechanical interference and/or the filtering body is in sealed contact with it.

28. The capsule according to claim 1, wherein, close to the upper rim, the filtering body comprises a shoulder which is substantially annular about the axis of extension and which projects radially relative to the rest of the filtering body with reference to the axis of extension, and wherein the coupling portion comprises a counter-shoulder which is substantially annular about the axis of extension and also projects radially, with reference to the axis of extension, relative to the portion of the first side wall adjacent to it on the lower wall side, said shoulder resting on the counter-shoulder and said upper rim being coupled to an annular region of the coupling portion located between the counter-shoulder and the upper edge.

29. The capsule according to claim 1, wherein the bottom portion of the filtering body is at least partly spaced from the lower wall to allow, during use, insertion of a piercing element in the capsule, through the lower wall, without the bottom portion of the filtering body being damaged.

30. The capsule according to claim 29, wherein the bottom portion comprises an outer annular zone and an inner zone, the outer annular zone being spaced from the lower wall to allow, during use, insertion of a piercing element in the capsule, through the lower wall, without the bottom portion of the filtering body being damaged, the inner zone in contrast being close to the lower wall.

31. The capsule according to claim 1, wherein the lower wall can be pierced during use to allow the beverage to come out of the capsule, and wherein, during use, a piercing element can be inserted between the filtering body and the outer body, without damaging the filtering body, following penetration through the lower wall.

* * * * *